US010938171B1

(12) United States Patent
Shultz et al.

(10) Patent No.: US 10,938,171 B1
(45) Date of Patent: Mar. 2, 2021

(54) PORTABLE POWER DISTRIBUTION UNIT FOR 400 HERTZ POWER

(71) Applicant: Innovative Electrical Design, Inc., Plattsburgh, NY (US)

(72) Inventors: Preston D. Shultz, Woodstock, CT (US); Kevin Crowl, Lewis, NY (US)

(73) Assignee: Innovative Electrical Design, Inc., Plattsburgh, NY (US)

( * ) Notice: Subject to any disclaimer, the term of this patent is extended or adjusted under 35 U.S.C. 154(b) by 54 days.

(21) Appl. No.: 16/593,456

(22) Filed: Oct. 4, 2019

Related U.S. Application Data

(60) Provisional application No. 62/741,084, filed on Oct. 4, 2018.

(51) Int. Cl.
*H01R 13/53* (2006.01)
*H01R 31/06* (2006.01)
*F42B 35/00* (2006.01)

(52) U.S. Cl.
CPC ..... *H01R 31/065* (2013.01); *H01R 13/53* (2013.01); *F42B 35/00* (2013.01); *H01R 2201/20* (2013.01)

(58) Field of Classification Search
None
See application file for complete search history.

(56) References Cited

U.S. PATENT DOCUMENTS 5,209,670 A * 5/1993 Meurer ..... H01R 13/68 439/101
5,614,896 A * 3/1997 Monk ..... F41G 7/006 340/945
6,696,925 B1 * 2/2004 Aiello, Jr. ..... H01F 27/002 340/12.38
7,547,997 B1 * 6/2009 Simunek ..... H01R 29/00 307/154
2005/0212526 A1 * 9/2005 Blades ..... G01R 31/67 324/543
2006/0194467 A1 * 8/2006 Beasley ..... H01R 13/6675 439/339
2009/0253309 A1 * 10/2009 Didier ..... H01R 13/512 439/686
2011/0186096 A1 * 8/2011 Nordlund ..... B64F 5/30 134/198
2019/0356510 A1 * 11/2019 Lee ..... H04B 10/2589
2020/0052481 A1 * 2/2020 D'Oracio De Almeida ..... H02H 7/22
2020/0282849 A1 * 9/2020 Niederl ..... B60L 53/14

* cited by examiner

*Primary Examiner* — Truc T Nguyen
(74) *Attorney, Agent, or Firm* — Downs Rachlin Martin PLLC

(57) ABSTRACT

A portable power distribution unit for safely distributing high wattage power supplied from mobile generators to lower power test adapter units and systems. Embodiments disclosed include a structurally rigid housing shaped to facilitate secure holding by an operator's foot, a 400 Hz power connector adapted for connection to a mobile power generator, a circuit breaker matched to the rating of the system to be powered and connections for conversion of the six-pin output from the mobile generator to a three or four-pin input for the system to be powered.

17 Claims, 3 Drawing Sheets

PORTABLE POWER DISTRIBUTION UNIT FOR 400 HERTZ POWER

RELATED APPLICATION

The present application claims priority to U.S. provisional application No. 62/741,084 filed Oct. 4, 2018, entitled "Portable Power Distribution Unit for 400 Hertz Power," which is incorporated by reference in its entirety herein.

FIELD OF THE DISCLOSURE

The present disclosure generally relates to the field of portable power distribution devices. In particular, the present invention is directed to portable power distribution units for distribution of 400 Hz power from mobile power systems and generators.

BACKGROUND

Many advanced munitions, particularly those associated with aircraft, operate on 400 Hertz power due to the advantages such high frequency power can provide in component design such as lighter weight transformers and motors. Testing and programming of such advanced munitions thus requires 400 Hz power supply. A common 400 Hz power supply is a mobile generator used to supply ground power to an aircraft. In order to meet aircraft ground power requirements, such mobile power supplies typically supply 400 Hz, 3-phase power at 72 kW and 270 VDC. Examples of such 400 Hz power supplies used, for example, by the U.S. Military and other countries, include the Dash-60 and Dash-86 power generators.

In addition to the 400 Hz power supply, testing and programming typically requires a test interface or adapter unit between the power supply and advanced munition to be tested or programmed. An adapter unit used as an interface for this purpose is a Common Munitions Bit/Reprogramming Equipment ("CMBRE"). The CMBRE is a common piece of support equipment used to interface with weapon systems to initiate built-in tests, report BIT results, and upload/download flight software. The CMBRE provides munitions support equipment developed as a "common" system for multiple munitions platforms. However, because the power requirements for individual munitions are generally far less than for the aircraft serviced by typical mobile ground power supplies, test adapter units, such as the CMBRE, also require less power than generated by the common mobile ground power supplies which must also power aircraft. Typical advanced munitions and thus test adapter unit power requirements are in the range of about 4 kW or less at only 120 VDC.

Present solutions for powering test adapter units for advanced munitions in testing and programing using available aircraft 400 Hz mobile power supplies (such as the Dash-60 or Dash-86) are less than satisfactory and generally utilize just a simple cable pigtail. One such pigtail, called "W-5 connector" is essentially a six-pin, 400 Hz, 72 kW, 270 VDC ground power connector at one end connected to a four-pin, low wattage, low voltage connector at the opposite end. The conductors for the two extra pins in the six-pin ground power connector are simply looped back on themselves within the connector. While the W-5 connector with this configuration has been in use for many years, it is less than satisfactory for a number of reasons.

One problem is the lack of circuit breaker or other current-limiting device between the power supply and the test adapter unit. Another significant problem is the difficulty of use of the connectors, which require a relatively high connection force to make a proper electrical connection. Similar high removal force is then also required to disconnect the system. Soldiers and airmen tasked with testing and programming operations frequently struggle with the connection because of the high insertion force and relatively small, difficult to grasp 400 Hz connector. An additional challenge is that any power connection solution for testing and programming operations for advanced munitions must be able to withstand harsh environments frequently encountered in remote and outdoor operations at all times of the year, as specified, for example, by Mil-PRF-28800 Class 1. There remains a need in the art for a solution that addresses these and other deficiencies of current devices and methods.

SUMMARY OF THE DISCLOSURE

A portable power distribution unit for safely distributing high wattage power supplied from mobile generators to lower power test adapter units and systems, such as CMBRE systems, is disclosed. In one embodiment, a mobile power distribution unit comprises a 400 Hz power connector adapted for connection to a mobile power generator outputting 400 Hz power in the range of 72 kW and 270 VDC. A housing contains a circuit breaker matched to the rating of the system to be powered and provides connections for conversion of the six-pin output from the mobile generator to a three or four-pin input for the system to be powered. Integration of the components into a single compact unit that is easily handled by personnel in the field meets a long-felt need for improved, easier to handle and safe power distribution and conversion for such systems.

In one embodiment a portable power distribution unit for distributing 3-phase, 400 Hz power from high wattage generators to low power equipment, includes a structurally ridged housing having a step portion defining an area configured to receive and support the force of an operator's foot to firmly secure the housing against the ground or other support surface and a 400 Hz power connection receptacle portion defining an opening configured to receive a 400 Hz power connector therein. A high wattage, 3-phase, 400 Hz, six-pin, male power connector is mounted in the receptacle portion opening. A low wattage power receptacle extends from the housing for connection to low power equipment. A 30 amp or lower circuit breaker is disposed in the structurally rigid housing with the circuit breaker being electrically connected between the high wattage, 3-phase, 400 Hz power connector and the low wattage power receptacle.

In another embodiment a portable power distribution unit for distributing 3-phase, 400 Hz power from high wattage generators to equipment with low power requirements, includes a structurally ridged housing having a step portion defining an area configured to receive and support the force of an operator's foot to firmly secure the housing against the ground or other support surface and a 400 Hz power connection receptacle portion defining an opening configured to receive a 400 Hz power connector therein. A high wattage, 3-phase, 400 Hz, six-pin, male power connector is mounted in the receptacle portion opening, and wherein two of the six pins are connected in an electrical loop within said housing. A 3-phase, four-line circuit breaker disposed in the structurally ridged housing, wherein each line of the circuit breaker is electrically connected to one pin of the 400 Hz power connector. A low wattage, four-line, power receptacle connected to the circuit breaker opposite the high wattage 400 Hz connector and extending from the housing for connection to low power equipment.

In a further alternative embodiment of a portable power distribution unit, the receptacle portion of the structurally rigid housing extends above the step portion of the housing. The receptacle portion thus defines an upwardly extending side wall providing a raised edge on an inner side of the step portion to facilitate a user locating his or her foot on the step portion.

BRIEF DESCRIPTION OF THE DRAWINGS

For the purpose of illustrating the present disclosure, the drawings show aspects of one or more embodiments. However, it should be understood that the present disclosure is not limited to the precise arrangements and instrumentalities shown in the drawings, wherein:

FIGS. 4A and 4B are computer-generated solid model depictions of an embodiment of a power distribution unit in accordance with the present disclosure, wherein FIG. 4A is a front perspective view and FIG. 4B is a rear perspective view.

DETAILED DESCRIPTION

Figure 2:
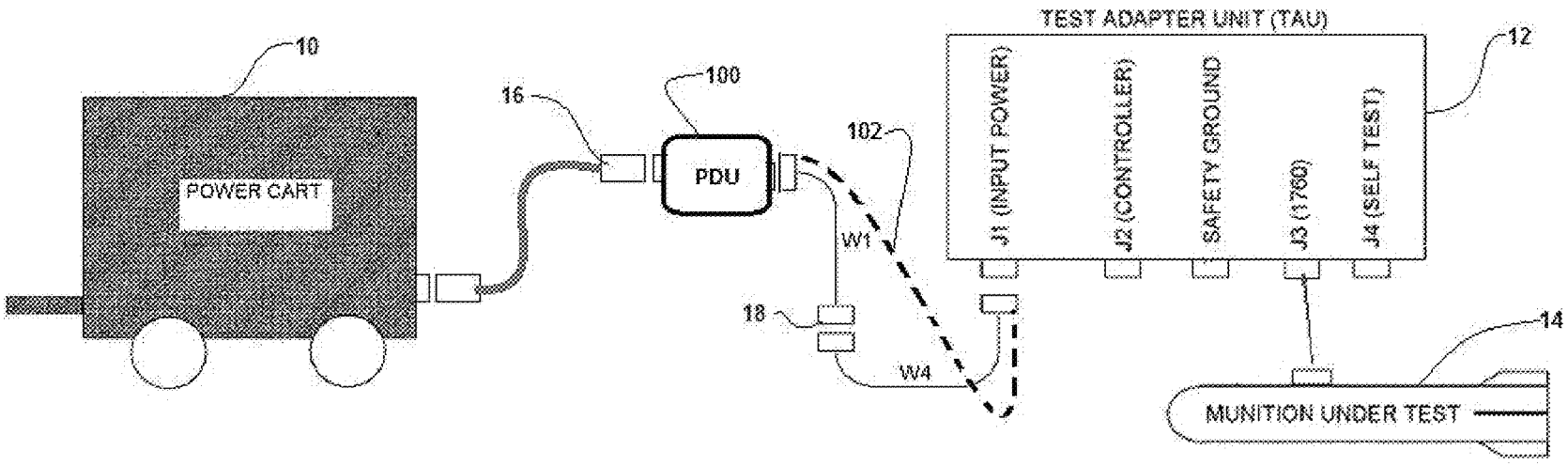
FIG. 2 is a schematic diagram depicting use of an embodiment of a portable power distribution unit as described herein in connection with CMBRE operations.

In the following description, references are made to illustrative embodiments for carrying out inventions as defined in the appended claims. It is understood that other embodiments may be utilized without departing from the scope of invention defined in the claims. For purposes of clarity, the same reference numbers are used in the drawings to identify similar elements. Unless otherwise indicated, drawing elements are not shown to scale.

Figure 1:
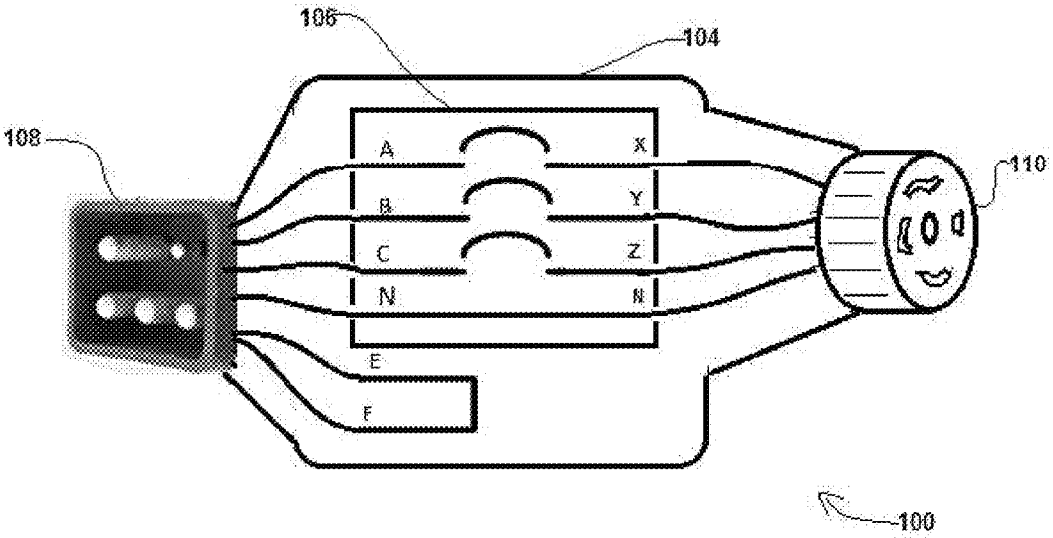
FIG. 1 is a schematic diagram of a portable power distribution unit for 400 Hz power according to embodiments disclosed herein.
Figure 3B:
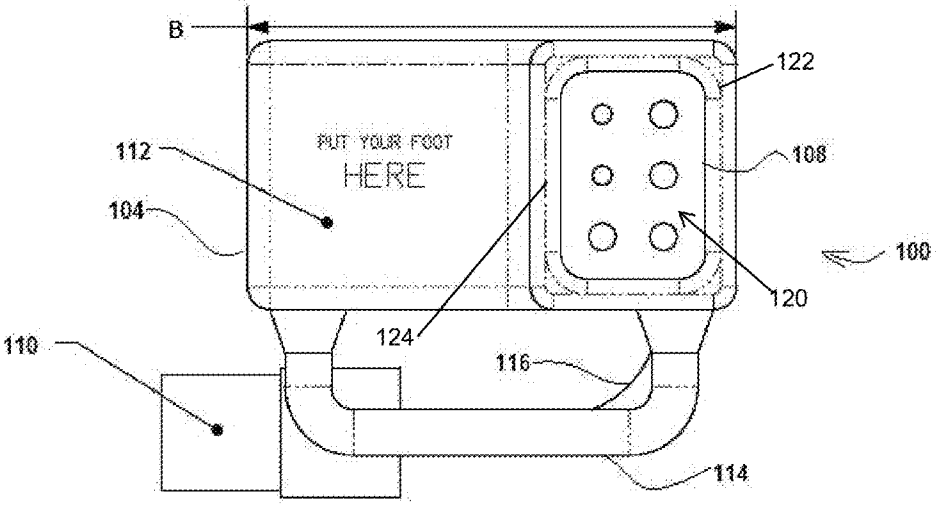
FIGS. 3A, 3B and 3C are front, top and end views, respectively, of an embodiment of a portable power distribution unit in accordance with the present disclosure.
Figure 3A:
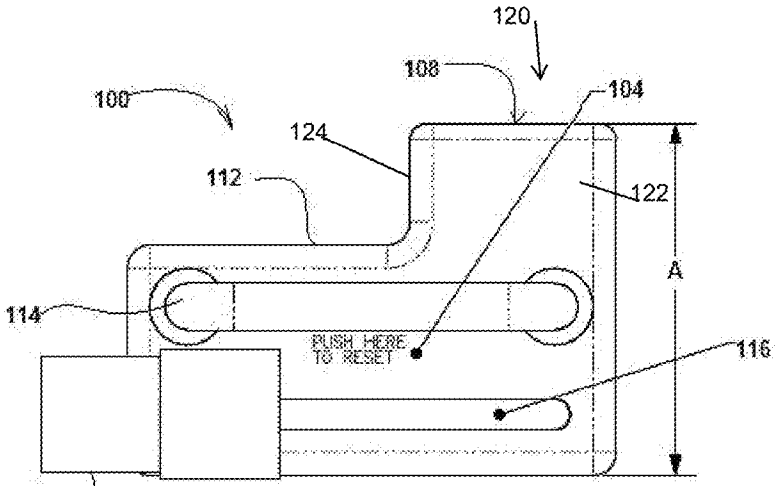
Figure 3C:
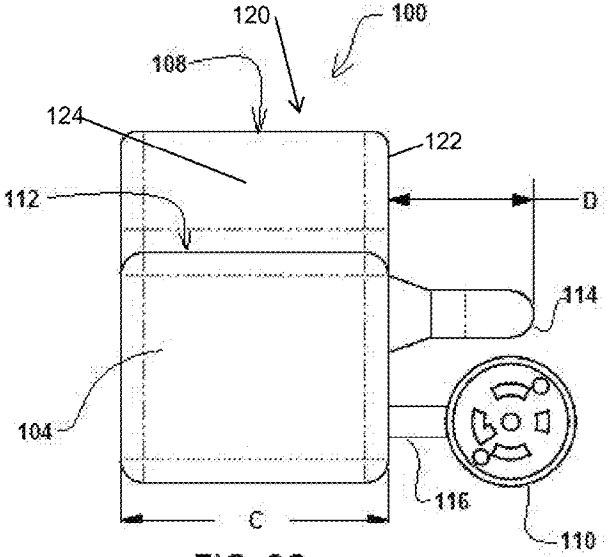

FIG. 1 schematically depicts an embodiment of a power distribution unit ("PDU") 100 for distributing 3-phase, 400 Hz power from high wattage generators to operational units such has test adaptor units that require power at lower wattages. In this illustrative embodiment, PDU 100 includes housing 104 containing 3-phase circuit breaker 106 through which electrical connections are provided between the input connector 108, comprising in this case a six-pin 400 Hz male connector rated at 72 kW or higher, and the output connector 110, comprising in this case a 400 Hz, 4-pole, twist lock connector rated at about 4-6 kW or, alternatively rated at 20-30 amps. Persons of ordinary skill will appreciate that different connectors and ratings may be utilized as appropriate for a particular system without departing from the teachings of the present disclosure. As used herein, high wattage means about 70 kW or higher, and low wattage means about 10 kW or lower.

Because in this example input connector 108 includes six conductors, whereas output connector 110 includes only four conductors, two of the input conductors (E, F) are looped within PDU housing 104. Selection of conductors A, B and C for connection through to connector 110 provides for 115 VAC power from the 72 kW power source. The neutral conductor (N) passes through without being broken by the circuit breaker switches. In one embodiment, circuit breaker 106 may comprise a magnetic breaker so as not to be subject to overheating and may be rated at between 15-30 amps. In a more specific embodiment, circuit breaker 106 is rated at 20 amps.

An example of a system for mobile testing or programing operations utilizing an embodiment of PDU 100 is schematically depicted in FIG. 2. In this example, PDU 100 is connected to mobile power source 10 by a conventional, six-pin, high wattage, 400 Hz cable 16 with connectors. Output at 115 VAC from PDU 100 is delivered through conventional test operations cables 18 (for example, W1 and W4 pigtails) or, alternatively, may be provided through a single special purpose cable 102 with appropriate mating connectors. Appropriate power at appropriate voltage, protected by an appropriately sized three-pole circuit breaker is thus provided to Test Adaptor Unit 12 and in turn to the munition under test 14.

Referring to FIGS. 3A-C and 4A-B, further details of PDU 100 are described. Housing 104 includes a rigid structural component surrounded by a protective material such as molded neoprene rubber. Circuit breaker 106 (FIG. 1) is contained within housing 104 as described above. Typically, circuit breaker 106 is provided with its own housing as schematically depicted in FIG. 1, which may form a part of the structural component of housing 104 in some embodiments. Six-pin, 400 Hz connector 108 may be a standard male-side aircraft ground power type connector, which is incorporated into housing 104 as shown. Connector 110, in some embodiments, may be, for example, a twist lock four-pin 400 Hz 30-amp connector. Connector 110 is attached to housing 104 by and electrically communicates with circuit breaker 106 through cable 116. For 20 amp rated devices, cable 116 may be, for example, provided as a 12/4 SOOW cable, i.e., a 12 gauge, 4 conductor, 600 volt heavy duty portable electrical cord.

As previously mentioned, due to the insertion force required by specifications for 400 Hz six-pin connectors, the male and female halves of such connectors can be very difficult to separate. This is especially true when one-half of the connector is not fixed to a substantial structure, such as an aircraft. In order to provide support for insertion and separation, housing 104 has a lower portion/step area 112 on its upper surface to facilitate an operator placing a foot on the top of the PDU while it is resting securely on the ground or other substantial flat surface. Male 400 Hz connector 108 is positioned in an opening 120 defined in an upper, raised portion 122 of housing 104. Side wall 124 of upper portion 122 faces lower portion 112 and creates an effective edge to assist the operation in locating a foot on lower portion 112. Raised portion 122 also protects the pins of connector 108 and creates a receptacle for insertion of the female 400 Hz connector. If needed, a second operator can plug the female connector-half of supply cable 16 (FIG. 2) into male connector 108 of PDU 100. The reverse of the procedure is applied for removal of supply cable connector 16 from male connector 108 of PDU 100.

In certain applications, the size of PDU 100 may be important or specific sizes may be required by specification. In one embodiment, PDU 100 is designed to fit in a space envelop approximately 8 inches wide and 10 inches deep. Example dimensions for such an embodiment of PDU 100 that is so designed are shown below in Table I.

TABLE I

| Example Dimensions (approximate) | |
|---|---|
| A | 5.75" |
| B | 8.00" |
| C | 4.38" |
| D | 2.38" |

Figure 4A:
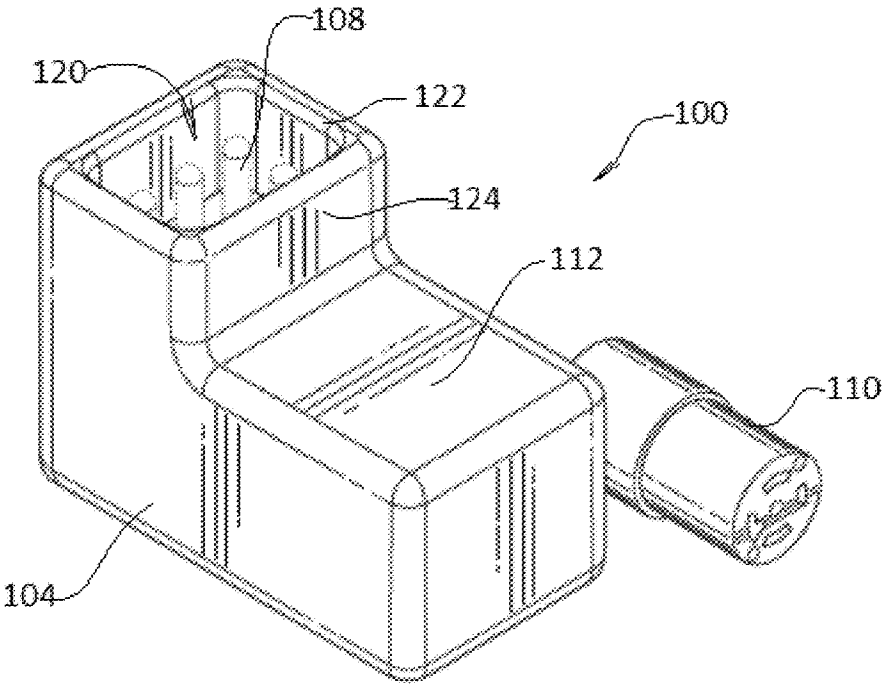
Figure 4B:
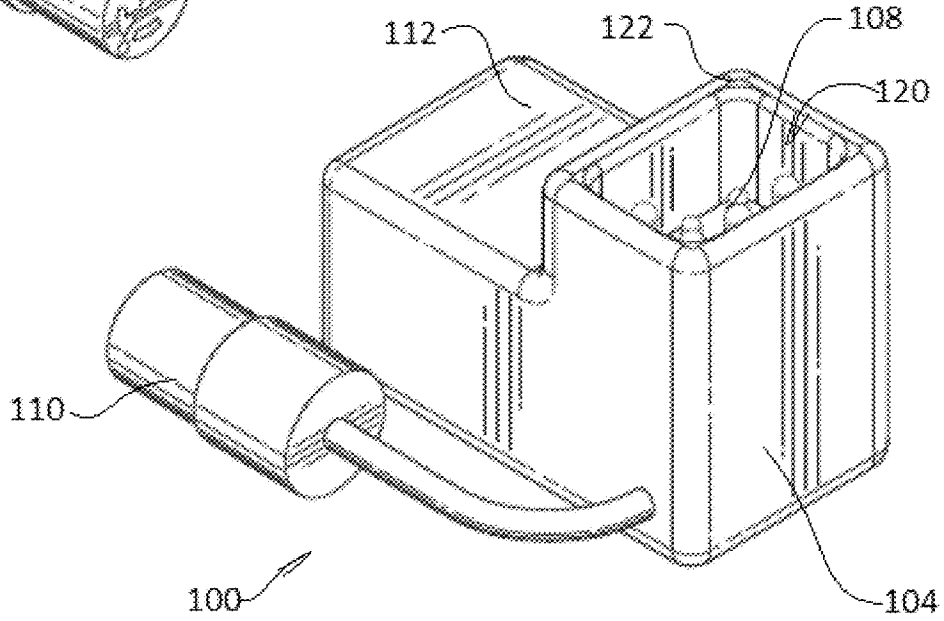

Also, handle 114 (FIGS. 3A-C) is optional and not included in the embodiment of FIGS. 4A and 4C.

Embodiments of PDU 100 as disclosed herein provide long-needed solutions to the various problems encountered in the past in distributing power from 400 Hz mobile power generators to test adapter units, such as CMBRE units as described above.

Various modifications and additions can be made without departing from the spirit and scope of the inventions defined by the appended claims. Features of each of the various embodiments described above may be combined with features of other described embodiments as appropriate in order to provide a multiplicity of feature combinations in associated new embodiments. Furthermore, while the foregoing describes different features or embodiments, what has been described herein is merely illustrative of the application of the principles of the present disclosure. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of the inventions as defined by the claims below.

What is claimed is:

1. A portable power distribution unit for distributing 3-phase, 400 Hz power from high wattage generators to low power equipment, comprising:

a structurally ridged housing having a step portion defining an area configured to receive and support the force of an operator's foot to firmly secure the housing against the ground or other support surface and a 400 Hz power connection receptacle portion defining an opening configured to receive a 400 Hz power connector therein;

a high wattage, 3-phase, 400 Hz, six-pin, male power connector mounted in the receptacle portion opening;

a low wattage power receptacle extending from the housing for connection to low power equipment; and 30 amp or lower circuit breaker disposed in said housing, said circuit breaker being electrically connected between said high wattage, 3-phase, 400 Hz power connector and said low wattage power receptacle.

2. The portable power distribution unit of claim 1, wherein said low wattage power receptacle comprises a four-pin, 3-phase receptacle electrically connected through said circuit breaker to four pins of said six-pin male power connector, and two pins of said six-pin power connector are connected in an electrical loop within said housing.

3. The portable power distribution unit of claim 1, wherein said low wattage power receptacle comprises a three-pin receptacle electrically connected through said circuit breaker to three pins of said six-pin male power connector.

4. The portable power distribution unit of claim 1, wherein said receptacle portion extends above said step portion and said receptacle portion defines an upwardly extending side wall providing a raised edge on an inner side of said step portion.

5. The portable power distribution unit of claim 1, wherein said low wattage receptacle is disposed on a cable extending from said housing.

6. The portable power distribution unit of claim 1, further comprising a protective rubber coating surrounding the structurally rigid housing.

7. The portable power distribution unit of claim 1, further comprising a handle extending from one side of said housing.

8. The portable power distribution unit of claim 1, further comprising a cable connectable between the low power receptacle and the low power equipment.

9. The portable power distribution unit of claim 1, wherein said housing and low power receptacle together are configured to be contained within a space envelope approximately 8 inches wide and 10 inches deep.

10. A portable power distribution unit for distributing 3-phase, 400 Hz power from high wattage generators to equipment with low power requirements, comprising:

a structurally ridged housing having a step portion defining an area configured to receive and support the force of an operator's foot to firmly secure the housing against the ground or other support surface and a 400 Hz power connection receptacle portion defining an opening configured to receive a 400 Hz power connector therein;

a high wattage, 3-phase, 400 Hz, six-pin, male power connector mounted in the receptacle portion opening, and wherein two of said six pins are connected in an electrical loop within said housing;

a 3-phase, four-line circuit breaker disposed in said housing, wherein each line of the circuit breaker is electrically connected to one pin of said 400 Hz power connector; and a low wattage, four-line, power receptacle connected to said circuit breaker opposite said high wattage 400 Hz connector and extending from the housing for connection to low power equipment.

11. The portable power distribution unit of claim 10, wherein said receptacle portion extends above said step portion and said receptacle portion defines an upwardly extending side wall providing a raised edge on an inner side of said step portion.

12. The portable power distribution unit of claim 10, wherein said circuit breaker is rated at about 20-30 amps.

13. The portable power distribution unit of claim 10, wherein said circuit breaker is disposed within a circuit breaker housing within the structurally ridged housing.

14. The portable power distribution unit of claim 13, wherein said circuit breaker housing is integrated into the structurally ridged housing.

15. A portable power distribution unit for distributing 3-phase, 400 Hz power from high wattage generators to equipment with low power requirements, comprising:

a structurally ridged housing having an upper surface with a lower step portion and an upper connection receptacle portion, wherein said lower step portion defines an area bounded by a raised edge on one side configured to receive and support the force of an operator's foot to firmly secure the housing against the ground or other support surface, and wherein the connection receptacle portion defines an opening configured to receive a 400 Hz power connector therein, said receptacle portion extending above said step portion with an upwardly extending side wall defining said raised edge on an inner side of said step portion;

a high wattage, 3-phase, 400 Hz, six-pin, male power connector mounted in the receptacle portion opening, and wherein two of said six pins are connected in an electrical loop within said housing;

a 3-phase, four-line, 20-30 amp circuit breaker disposed in said housing, wherein each line of the circuit breaker is electrically connected to one pin of said 400 Hz power connector, one said line being an unbroken ground connection line; and a 3-phase, 20-30 amp rated power receptacle disposed on a cable extending from the structurally ridged housing connected to the four lines of said circuit breaker opposite said high wattage 400 Hz connector.

16. The portable power distribution unit of claim 15, wherein said circuit breaker is disposed within a circuit breaker housing within the structurally ridged housing.

17. The portable power distribution unit of claim 16, wherein said circuit breaker housing is integrated into the structurally ridged housing.

* * * * *